US009946197B2

(12) United States Patent
Schlumm et al.

(10) Patent No.: US 9,946,197 B2
(45) Date of Patent: Apr. 17, 2018

(54) CUSTOM COLOR INK MIXING FOR ELECTRO PHOTOGRAPHIC PRINTING

(71) Applicant: Hewlett-Packard Indigo B.V., Amstelveen (NL)

(72) Inventors: Doron Schlumm, Kfar Harif (IL); Zvi Shemer, Aley Zahav (IL); Mark Sandler, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/365,483

(22) Filed: Nov. 30, 2016

(65) Prior Publication Data

US 2017/0082951 A1 Mar. 23, 2017

Related U.S. Application Data

(63) Continuation of application No. 14/787,264, filed as application No. PCT/EP2013/059018 on Apr. 30, 2013, now Pat. No. 9,535,363.

(51) Int. Cl.

| | |
|---|---|
| ***G03G 15/00*** | (2006.01) |
| ***G03G 15/08*** | (2006.01) |
| ***G03G 15/01*** | (2006.01) |
| ***G03G 15/10*** | (2006.01) |

(52) U.S. Cl.

CPC ..... *G03G 15/0889* (2013.01); *G03G 15/01* (2013.01); *G03G 15/0121* (2013.01); *G03G 15/0184* (2013.01); *G03G 15/0827* (2013.01); *G03G 15/104* (2013.01)

(58) Field of Classification Search

CPC ..... G03G 15/0889

USPC ..... 399/233

See application file for complete search history.

(56) References Cited

U.S. PATENT DOCUMENTS

| | | | |
|---|---|---|---|
| 6,526,244 | B1 | 2/2003 | Viturro et al. |
| 6,947,175 | B1 | 9/2005 | Caruthers |
| 2001/0022901 | A1 | 9/2001 | Suetsugu |
| 2003/0096186 | A1 | 5/2003 | Viturro et al. |

(Continued)

FOREIGN PATENT DOCUMENTS

| | | |
|---|---|---|
| WO | WO-2009/014537 | 1/2009 |

OTHER PUBLICATIONS

Gossett, Nathan, et al., "Paint Inspired Color Mixing and Compositing for Visualization" IEEE Symposium on Information Visualization 2004, pp. 113-117.

(Continued)

*Primary Examiner* — Quana M Grainger
(74) *Attorney, Agent, or Firm* — Steven R. Ormiston

(57) ABSTRACT

In one example, a liquid electro photographic printing apparatus includes: multiple base color ink containers each to contain a different base color ink; multiple base color ink dispersion units each connected to a corresponding base color ink container to contain a diluted base color ink and to a corresponding base color binary ink developer unit; and a custom color ink container connected to each of the base color ink containers or to each of the base color ink dispersion units, to contain and mix a custom color ink, and connected to a custom color ink binary developer unit. The printing apparatus is configured to print any of the custom and base color inks using the custom color ink binary developer unit and the base color binary ink developer units.

12 Claims, 5 Drawing Sheets

(56) References Cited

U.S. PATENT DOCUMENTS

| | | | | |
|---|---|---|---|---|
| 2004/0135859 | A1* | 7/2004 | German | B41J 2/175 347/95 |
| 2005/0264619 | A1 | 12/2005 | Walton et al. | |
| 2007/0097175 | A1* | 5/2007 | Stelter | B41J 2/211 347/43 |
| 2008/0310870 | A1 | 12/2008 | Berg et al. | |
| 2012/0046987 | A1 | 2/2012 | Lee | |
| 2012/0273529 | A1 | 11/2012 | Baker et al. | |

OTHER PUBLICATIONS

International Search Report and Written Opinion for International Application No. PCT/EP2013/059018 dated Jan. 24, 2014 (9 pages).

* cited by examiner

CUSTOM COLOR INK MIXING FOR ELECTRO PHOTOGRAPHIC PRINTING

CROSS REFERENCE TO RELATED APPLICATIONS

This is a continuation of U.S. application Ser. No. 14/787,264 filed Oct. 26, 2015 which is itself a 35 U.S.C. 371 national stage filing of international application no. PCT/EP2013/059018 filed Apr. 30, 2013, both incorporated herein in their entirety.

BACKGROUND

An example of a printing apparatus is a digital offset printing apparatus. These presses combine ink-on-paper quality with multi-color printing on a wide range of paper, foil and plastic substrates, i.e. print media. These digital printing presses offer cost-effective short-run printing, on-demand service, and on-the-fly color switching.

A digital offset printing apparatus works by using digitally controlled lasers or LED imaging modules for example, to create a latent image in the charged surface of a photo-imaging cylinder. The lasers are controlled according to digital instructions from a digital image file. Digital instructions can include various parameters, such as, image color, image spacing, image intensity, order of the color layers, etc. Ink is then applied to the partially-charged surface of the photo-imaging cylinder, recreating the desired image (or a single color separation of a corresponding color image). The image is then transferred from the photo-imaging cylinder to a heated blanket cylinder, and from the blanket cylinder to the desired substrate, which is placed into contact with the blanket cylinder by means of an impression cylinder.

An operator of a printing apparatus can prepare an ink of a certain color by mixing appropriate quantities of different colored inks. However, such methods of mixing an ink can be messy and require expertise to undertake. Moreover, such ink mixing methods are reliant on the operator's skill in mixing the ink and hence are sensitive to human error.

BRIEF DESCRIPTION OF THE DRAWINGS

The accompanying drawings illustrate examples of the principles described herein and are a part of the specification. The illustrated examples are merely examples and do not limit the scope of the claims.

DETAILED DESCRIPTION

In the following description, for purposes of explanation, numerous specific details are set forth in order to provide a thorough understanding of the present apparatus and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Examples described herein, and further examples which may be envisaged, relate to a printing apparatus comprising a plurality of base color ink containers, each for containing a different base color ink; and a custom color ink container for containing a custom color ink, the printing apparatus being configured to print any of said custom color ink and said different base color inks, from the custom color ink container and the plurality of base color ink containers, respectively, to a print medium, wherein the printing apparatus is configured to mix a custom color ink for said custom color ink container using a combination of any of said base color inks. It is to be noted that printing of any of the inks from an ink container may cover the possibility of feeding the ink from the container, via other parts of an ink supply apparatus, for example at least one further ink container, before printing the ink to a medium.

Further examples to be described relate to a method of mixing a custom color ink in a printing apparatus, for example using an example of printing apparatus described herein, the method including:

(a) mixing a custom color ink for the custom color ink container using a combination of any of the base color inks.

Figure 1:
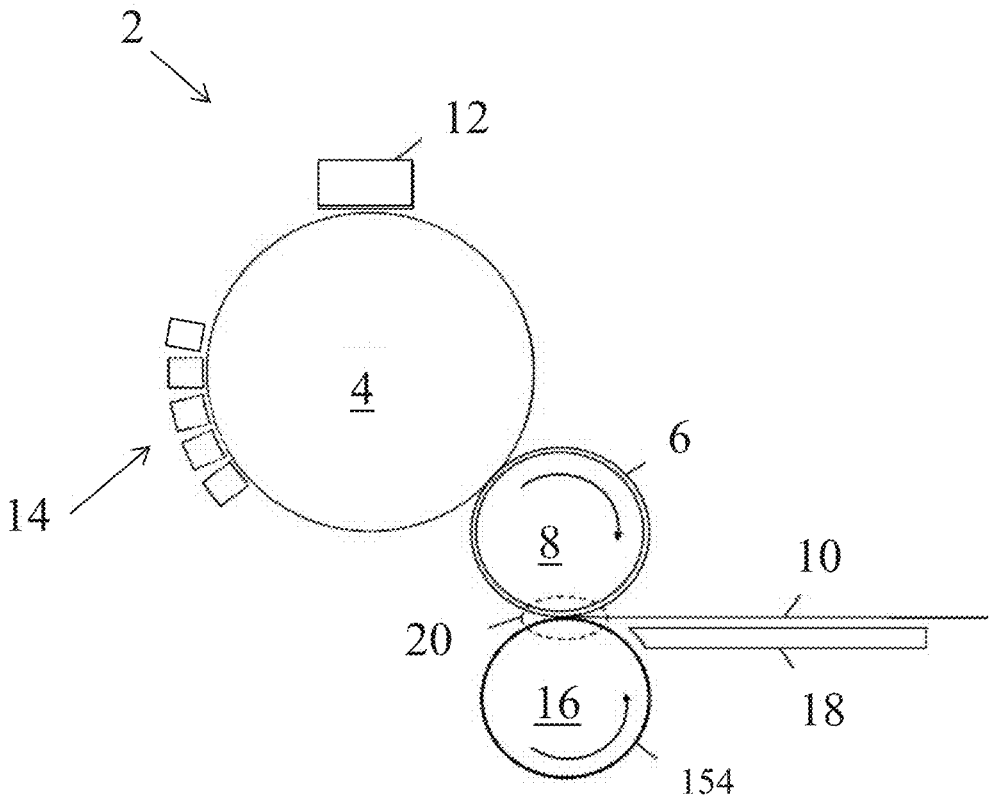
FIG. 1 shows schematically an illustrative printing apparatus according to an example.

FIG. 1 is a diagram of an illustrative example of a printing apparatus configured to mix a custom color ink.

The illustrative example printing apparatus 2 shown in FIG. 1 is a digital Liquid Electro Photographic (LEP) printing apparatus, which is an example of a digital offset printing apparatus. The term "Liquid Electro Photographic" or "LEP" refers to a process of printing in which a pattern of electrostatic charge is used to form a pattern of ink, corresponding with the electrostatic charge pattern, on the surface of a photo-imaging cylinder. These ink images are transferred to a heated blanket cylinder, which heating evaporates a liquid vehicle, and then to a print medium. The photo-imaging cylinder continues to rotate, passing through various stations to form the next image.

In the illustrative digital LEP printing apparatus 2, the desired image is communicated to the printing apparatus 2 in digital form. The desired image may include any combination of text, graphics and images. The desired image is initially formed on the photo-imaging cylinder 4, transferred to a blanket 6 on the outside of the blanket cylinder 8, and then transferred to the print medium 10. The blanket 6 may otherwise be referred to as an intermediate transfer member (ITM).

According to one illustrative example, an image is formed on the photo-imaging cylinder 4 by rotating a clean, bare segment of the photo-imaging cylinder 4 under the photo charging unit 12. The photo charging unit 12 includes a charging device such as corona wire, charge roller, or other charging device and a laser imaging portion. A uniform static charge is deposited on the photo-imaging cylinder 4 by the photo charging unit 12. As the photo-imaging cylinder 4 continues to rotate, it passes the laser imaging portion of the photo charging unit 12 that dissipates the static charges in selected portions of the image area to leave an invisible electrostatic charge pattern that represents the image to be printed.

Figure 2:
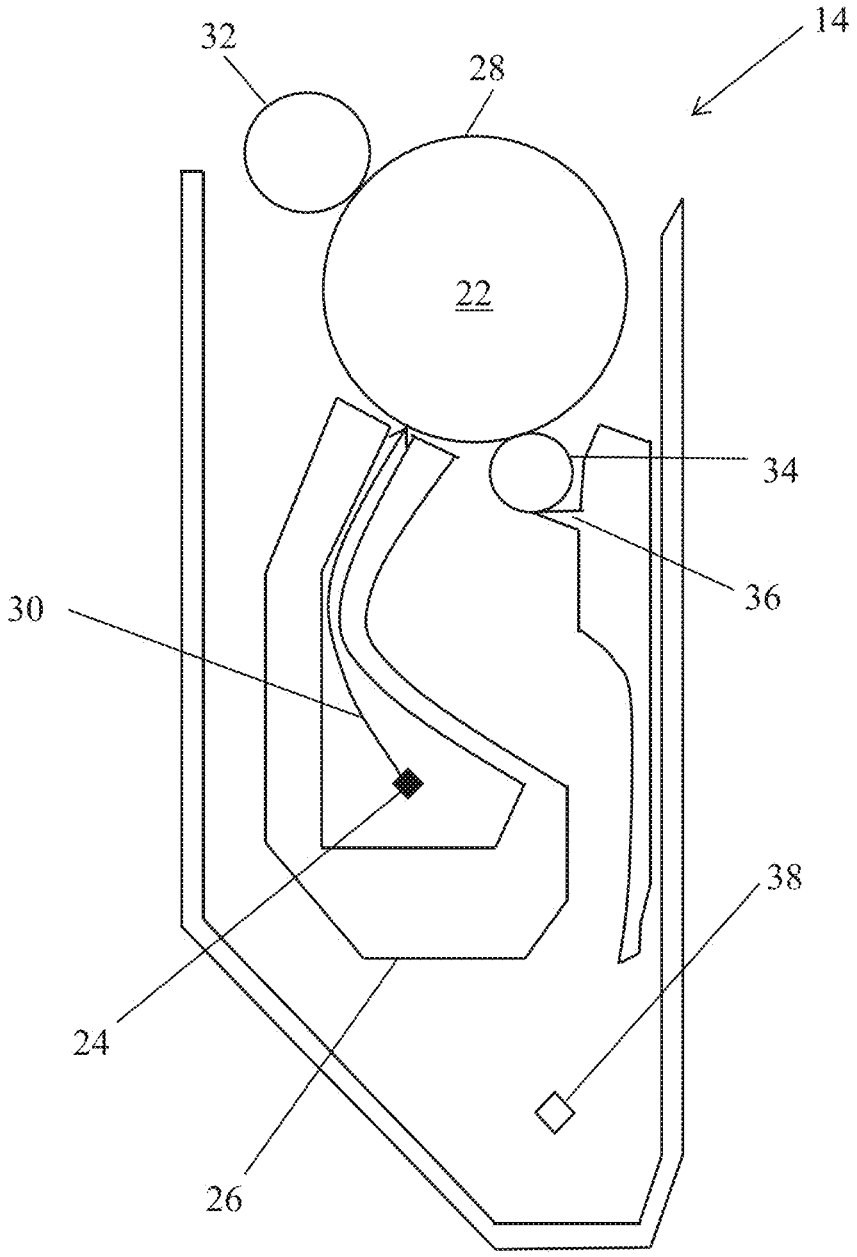
FIG. 2 shows schematically an illustrative binary ink developer (BID) for use within a printing apparatus in accordance with an example.

Ink is transferred onto the photo-imaging cylinder 4 by binary ink developer (BID) units 14. An example BID unit 14 is illustrated in FIG. 2, and described below. In this example, there are five BID units, one for each of four base color inks, for example cyan, magenta, yellow and black base color inks, and one for a custom color ink. In other examples the base color inks may be different colors than described or there may be more or less than four base color inks, for example, there may be six base color inks. In further examples, to increase the color gamut available for the custom color ink, one of the base color inks may be transparent. In some examples, there may be more than one BID unit for a custom color ink; for example, there may be between one and five BID units, each for a different custom color ink; in such examples, there may be a different custom color ink container for each different custom color ink. An example of the mixing of the custom color ink is described below, with reference to FIG. 3.

During printing, the appropriate BID unit is engaged with the photo-imaging cylinder 4. The engaged BID unit presents a uniform film of ink to the photo-imaging cylinder 4. The ink contains electrically charged pigment particles which are attracted to the opposing electrical fields on the image areas of the photo-imaging cylinder 4. The ink is repelled from the uncharged, non-image areas. The photo-imaging cylinder 4 now has a single color ink image on its surface.

The photo-imaging cylinder 4 continues to rotate and transfers the ink image to the ITM 6 of the blanket cylinder 8 which is heatable. The blanket cylinder transfers the image from the ITM to a sheet of media wrapped around an impression cylinder 16. In other examples the media may be web fed. This process may be repeated for each of the colored ink layers to be included in the final image. In other examples, the ink image for each different colored ink may be transferred to the ITM 6 before transferring the multi-colored image to the media.

The print medium 10 enters the printing apparatus 2 from the right as illustrated, passes over a feed tray 18, and is wrapped onto the impression cylinder 16. The print medium may have been pre-printed with a primer. As the print medium 10 contacts the ITM 6 of the blanket cylinder 8, the single color ink image is transferred to the print medium 10. The creation, transfer, and cleaning of the photo-imaging cylinder 4 is a continuous process, with hundreds of images being created and transferred per minute.

To form a single color image (such as a black and white image), one pass of the print medium 10 through the impression cylinder 16 and the blanket cylinder 8 completes the desired image. For a color image, the print medium 10 is retained on the impression cylinder 16 and makes multiple contacts with the blanket cylinder 8 as it passes through the nip 20. At each contact, an additional color plane may be placed on the print medium 10. The term nip refers to a region between two rollers where the rollers are in closest proximity. When a media sheet or other material passes through the nip 20, the distance between the two rollers can be adjusted to produce pressure on the media.

For example, to generate an image consisting of four base colors and a custom color, i.e. five colors, each color may be printed in turn. For example, for the second color, the photo charging unit 12 forms a second pattern on the photo-imaging cylinder 4 which receives the second base ink color from a second BID unit 14. Similar to that described above, this second ink pattern is transferred to the ITM 6 and impressed onto the print medium 10 as it continues to rotate with the impression cylinder 16. This process is repeated for the different colors, until the desired image with all five color planes is formed on the print medium. In examples where there are more or fewer different colors, the process is repeated the appropriate number of times for all color planes. Following the complete formation of the desired image on the print medium 10, the print medium 10 can exit the machine or be duplexed to create a second image on the opposite surface of the print medium 10. In other examples, where the print medium is web fed, all colors of an image may be provided onto the ITM and transferred to the print medium in one rotation of the ITM. Because the printing apparatus is digital, the operator can change the image being printed at any time and without manual reconfiguration.

FIG. 2 is a diagram of an illustrative example of a BID unit 14 of a printing apparatus, such as the printing apparatus 2 shown in FIG. 1. The BID unit 14 comprises ink transfer apparatus arranged for transferring ink from ink supply apparatus (not shown) to a developer roller 22; the developer roller 22 is arranged to transfer ink to a photo-imaging cylinder, such as the photo-imaging cylinder 4 shown in FIG. 1. In this example, the ink transfer apparatus comprises an ink inlet 24 and electrodes 26. The ink inlet 24 receives ink from an ink supply apparatus, which is described in more detail below, with reference to FIG. 3.

In this example, the ink received by the developer roller 22 is positively or negatively charged and enters the BID unit 14 through the ink inlet 24. The charge of the ink is provided by charged pigment particles. In the example where the ink is positively charged, the electrodes 26 in this example are held at a positive electrical potential, for example in the range of 0 to 1,500V, for example 1,500V. In this example, the developer roller 22, in use, is held at an electrical potential which is less than the potential of the electrodes 26, for example a positive voltage such as 400V. In other examples the ink may be negatively charged, and the electrodes 26 may be held at a negative voltage, for example −1,500V, and the developer roller 22 may be held at a less negative voltage such as −400V.

The developer roller 22 may be energized using a connector, for example made of carbon, which may be electrically connected to the developer roller surface 28 which in this example is metallic, such as aluminum, and which in turn may be connected to an electrical power supply.

The potential difference between the developer roller surface 28 and the ink supply electrodes 26 causes the charged ink to be electrostatically transferred from the ink inlet 24 to the developer roller surface 28 via the electrodes 26; an arrow 30 illustrates the direction of the ink flow.

In addition, the BID unit 14 for a printing apparatus may comprise a pressure roller 32, such as a squeegee roller, for applying pressure to the developer roller surface 28. This may remove excess liquid from the ink, which in an example comprises charged pigment particles and a liquid vehicle. The charged pigment particles are retained in a layer on the developer roller surface 28 rather than being transferred to the pressure roller 32, by holding the developer roller surface 28 at an appropriate non-zero electrical potential in this example.

In this example, a squeezer roller 34 and a scraper 36 may be used to clean the developer roller surface 28 by removing ink. Such removed ink may flow towards an ink outlet 38 for collection and re-use or discarding. Additional rollers (not shown) may be arranged to clean the squeezer roller and/or to enhance cleaning of the developer roller surface 28.

In an example, one of the BID units 14 of the printing apparatus previously described contains and is for printing a custom color ink. An example apparatus for supplying a plurality of base color inks and a custom color ink to different of the BID units 14 and for mixing a custom color ink is illustrated in FIG. 3.

Figure 3:
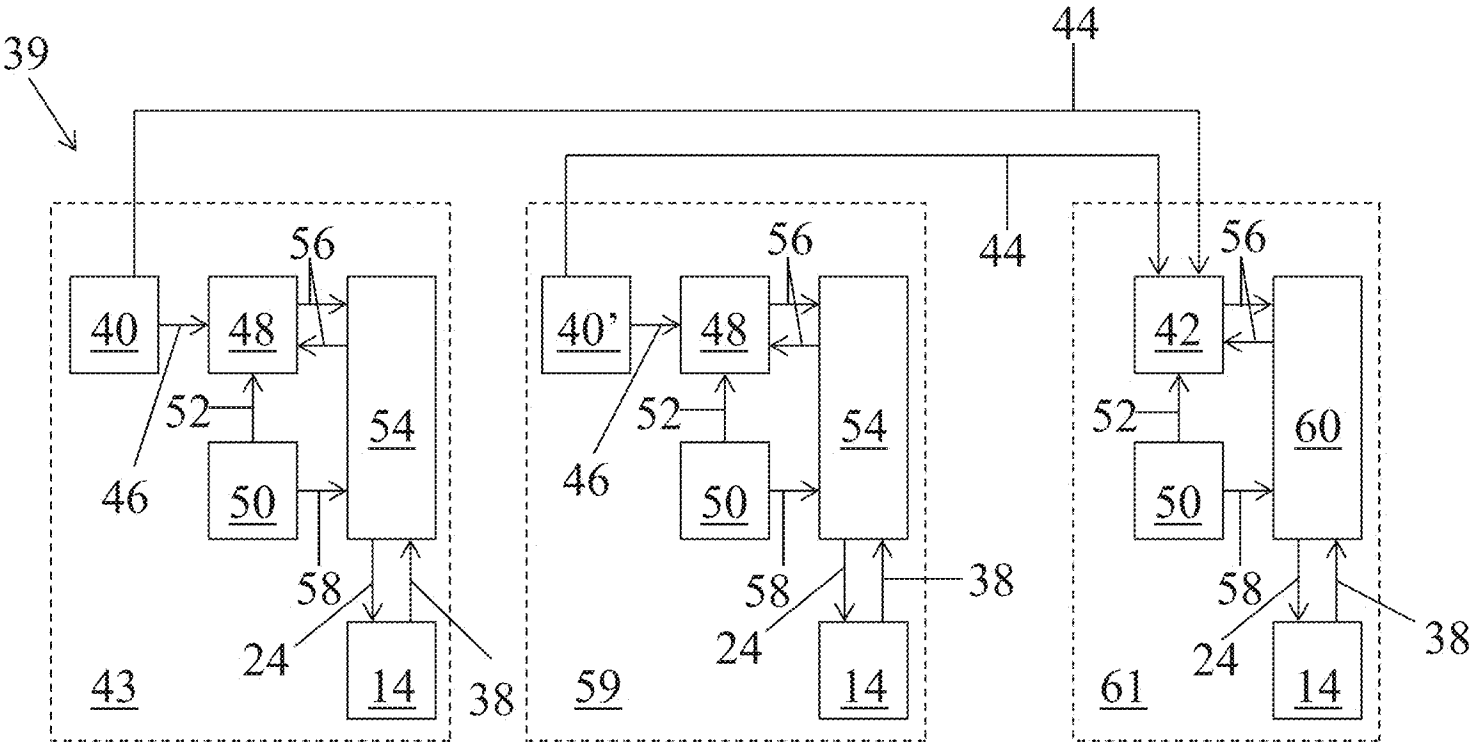
FIG. 3 shows schematically an illustrative ink supply and ink mixing apparatus according to an example.

An example ink supply and mixing apparatus 39 is shown in FIG. 3 comprises a first base color ink container 40 and a second base color ink container 40', each for containing a different base color ink. In this example, the first base color ink container 40 is arranged for containing yellow ink and the second base color ink container 40' is arranged for containing cyan ink. However, in other examples, the first and second base color ink containers 40, 40' may be arranged for containing other color inks. In further examples, there may be more than two base color ink containers; for example, there may be a first base color ink container for containing a first base color ink, such as a cyan base color ink, a second base color ink container for containing a second base color ink, such as a magenta base color ink, a third base color ink container for containing a third base color ink, such as a yellow base color ink, and a fourth base color ink container for containing a fourth base color ink, such as a black base color ink. In other examples, at least one of the base color inks is a primary color ink.

The example ink supply and mixing apparatus 39 illustrated in FIG. 3 also comprises a custom color ink container 42 for containing a custom color ink created from a combination of any of the base color inks.

In these examples, the base color inks and the custom color ink are each a liquid electro-photographic ink. For example, the base color inks and the custom color ink may comprise pigment particles suspended in a liquid vehicle, such as Isopar Oil™ (available from Exxon Mobil Corporation, 5959 Las Colinas Boulevard, Irving, Tex. 75039-2298, USA), although it is envisaged that other liquid vehicles may be used. A particle size of the pigment particles may be in the range of: 1 to 20 micro-meters; 1 to 15 micro-meters; 1 to 10 micro-meters; or 1 to 5 micro-meters. This small particle size compared with non-liquid electro-photographic ink systems facilitates the later described mixing of different base color inks to form a custom color ink, as the particles may be easily moved back and forth in a conduit without clogging.

A first base color ink supply apparatus 43, arranged for supplying the first base color ink from the first base color ink container 40 to the custom color ink container 42 and for supplying the first base color ink from the first base color ink container 40 to a BID unit 14, where it may be transferred to a print medium in accordance with the description above, will now be described.

The first base color ink supply apparatus 43 comprises a first conduit 44 which is arranged to supply the first base color ink from the first base color ink container 40 to the custom color ink container 42 for forming the custom color ink. The term "conduit" refers to any passage suitable for connecting a first location and a second location such that an ink may flow between the first and second locations and may be a pipe, channel or tube, for example. A pump, for example, may be used to pump the ink between the first and second locations via the conduit in a direction of flow indicated by arrows on the conduits in the FIG. 3. In other examples, a worm gear may be used to transfer the ink between the first and second locations via the conduit. In further examples in which the ink is electrically charged, the ink may be transferred between the first and second locations by surrounding the conduit with electrical coils.

In the example shown in FIG. 3, the first base color ink supply apparatus 43 further comprises a second conduit 46 which is arranged for supplying the first base color ink from the first base color ink container 40 to a dispersion unit 48. The dispersion unit 48 is further arranged to receive a liquid vehicle from a liquid vehicle container 50 via a third conduit 52.

In an example, the first base color ink container is arranged to contain a base color ink with a relatively high concentration of pigment particles in a liquid vehicle; for example, the first base color ink may contain a percentage by weight of between 4% and 40% of pigment particles. In further examples, the first base color ink contains a percentage by weight of between 20% and 40% of pigment particles. The base color ink may be transported to the dispersion unit 48 via the second conduit 46 and liquid vehicle may be added from the liquid vehicle container 50 via the third conduit 52 to dilute the base color ink, in other words, to reduce the concentration of pigment particles in the liquid vehicle.

The dispersion unit 48 is connected to a further base color ink container 54 via a fourth conduit 56 which allows ink to be transferred both to the further base color ink container 54 from the dispersion unit 48 and from the further base color ink container 54 to the dispersion unit 48. In an example in which a liquid vehicle is added to the base color ink when the base color ink is in the dispersion unit 48, the base color ink may be repeatedly transferred, back and forth, between the dispersion unit 48 and the further base color ink container 54 such that the base color ink is mixed with the liquid vehicle. For example, this repeated transfer may occur until the base color ink and the liquid vehicle are substantially homogeneously dispersed with each other. "Substantially homogeneously dispersed" denotes that the diluted base color ink, when printed, has an even color intensity to the eye of an observer.

In an example, the first base color ink supply apparatus 43 further comprises a sensor (not shown) for determining the concentration of pigment particles within the base color ink contained within the dispersion unit 48 and/or within the further base color ink container 54. This sensor may be used to monitor the concentration of the base color ink during transfer between the dispersion unit 48 and the further base color ink container 54, allowing transfer, and hence mixing, to be ceased when the concentration of the base color ink in the dispersion unit 48 is sufficiently equal to the concentration of the base color ink in the further base color ink container 54 that the base color ink is suitable for printing. For example, the concentration of the base color ink in the dispersion unit 48 may be substantially equal to the concentration of the base color ink in the further base color ink unit. "Substantially equal" in this example denotes that the concentration of the pigment particles in the base color ink in the dispersion unit 48 is within a range of +/−0.05%, +/−0.04%, +/−0.03%, +/−0.02% or +/−0.01% of the concentration of the pigment particles in the base color ink in the further base color ink container 54. In an example, the sensor is an optical density sensor, such as that described in US patent application US 2012/0320378.

In the above example, the liquid vehicle is transferred to the dispersion unit 48 from the liquid vehicle container 50 via the third conduit 52, however, in other examples, the liquid vehicle may be transferred directly from the liquid vehicle container 50 to the further base color ink container 54 via a fifth conduit 58.

In the example previously described, liquid vehicle is added to the base color ink in the dispersion unit 48 to dilute the base color ink. However, in further examples, no liquid vehicle may be added to the base color ink, and the base color ink may be transferred from the base color ink container 40 to the further base color ink container 54, via the dispersion unit 48, without the addition of a liquid vehicle.

The base color ink in the further base color ink container 54 may then be transferred to the BID unit 14 via ink inlet 24; an example BID unit 14 is illustrated in FIG. 2 and has been previously described. In an example, the base color ink may be transferred to the appropriate BID unit 14 once the base color ink and the liquid vehicle are substantially homogeneously dispersed by the repeated transfer between the dispersion unit 48 and the further base color ink container 54. The base color ink may then be transferred from the BID unit 14 to a print medium, as described above with reference to FIG. 1. Any excess ink after printing may be transferred back from the BID unit 14 to the further base color ink container 54 via ink outlet 38. In a further example, the base color ink may be transferred to the BID unit 14 from the further base color ink container 54 without repeated transfer between the dispersion unit 48 and the further base color ink container 54.

A second base color ink supply apparatus 59 for supplying a second base color ink from the second base color ink container 40' to a print medium and to the custom color ink container 42 is similar to the first base color ink supply apparatus 43; similar features are labeled with the same reference numerals in FIG. 3, and corresponding descriptions should be taken to apply here also, i.e. the above description for the first base color ink supply apparatus 43 also applies for the second base color ink supply apparatus 59. Similarly, for a printing apparatus 2 for printing more than two base color inks, each base color ink supply apparatus for each different base color ink may be similar to the first base color ink supply apparatus 43 described above.

Figure 5:
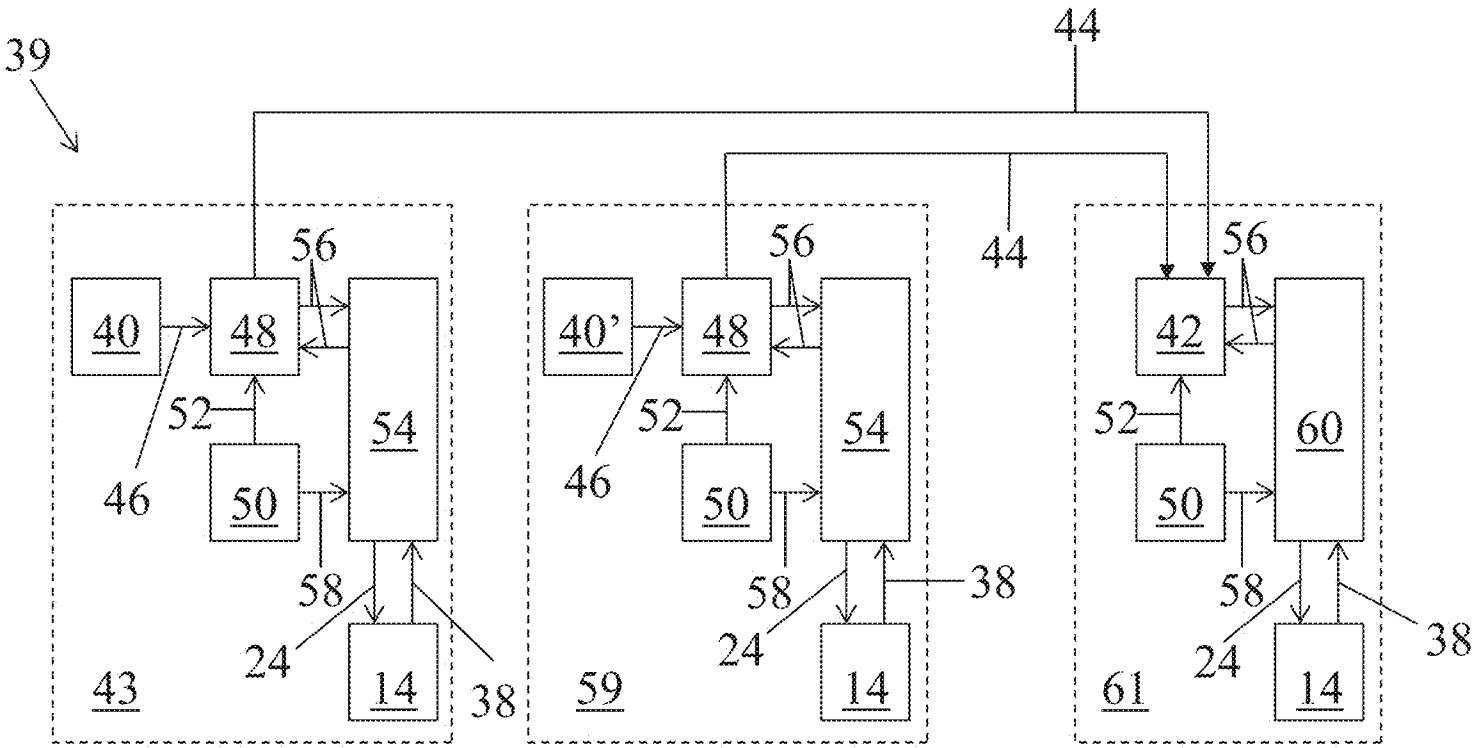
FIG. 5 shows schematically an illustrative ink supply and ink mixing apparatus according to an example.

Each base color ink supply apparatus 43, 59 is arranged to supply a different base color ink to the custom color ink container 42 to create a combination of base color inks. In some examples, a quantity of base color ink from each base color ink container 40, 40' may be supplied to the custom color ink container 42. However, in other examples, only a subset of base color inks from the available range of base color inks are supplied to the custom color ink container 42. In another example, shown in FIG. 5, diluted base color inks may be supplied from the dispersion units 48 rather than the base color ink containers. The combination of base color inks received by the custom color ink container 42 may then be mixed to form a custom color ink.

In the example shown in FIG. 3, there is a custom color ink supply apparatus 61, which is arranged to supply custom color ink to a print medium. Features are similar to those of the first base color ink supply apparatus 43 described previously; such features are labeled in FIG. 3 and referred to herein using the same reference numerals; corresponding descriptions should apply here also. The custom color ink supply apparatus 61 comprises the custom color ink container 42, which may perform a similar function to the dispersion unit 48 described previously and a further custom color ink container 60, which are connected via a fourth conduit 56. The custom color ink may thus be transferred from the custom color ink container 42 to the further custom color ink container 60 and then to the appropriate BID unit 14, which receives ink from the further custom color ink container 60 via ink inlet 24. The custom color ink may then be transferred from the BID unit 14 to a print medium.

In an example, the printing apparatus 2, comprising the base color ink supply apparatus 43, 59 and the custom color ink supply apparatus 61, is configured to decrease the concentration of at least one of the custom color ink and the base color inks. An example in which the concentration of the base color ink is decreased has been described above. For the example in which the concentration of the custom color ink is decreased, liquid vehicle may be transferred from the liquid vehicle container 50 within the custom color ink supply apparatus 61 to either the custom color ink container (via a third conduit 52) or the further custom color ink container 60 (via a fifth conduit 58) to dilute, in other words decrease the concentration of, the custom color ink.

In an example, to mix the added liquid vehicle with the custom color ink, the unmixed custom color ink, which includes a mixture of base color inks, may be repeatedly transferred between the custom ink color container 42 and the further custom color ink container 60. At the start of this mixing, the custom color ink container 42 contains part of the custom color ink with a first concentration and the further custom color ink container 60 contains a different part of the custom color ink with a second concentration. The apparatus may be configured to transfer the custom color ink between the custom color ink container 42 and the further custom color ink container 60 via the fifth conduit 58 repeatedly, back and forth, to mix the custom color ink from the custom color ink container 42 with the custom color ink from the further custom color ink container 60, thereby changing the first concentration and the second concentration of different parts of the ink, until the first concentration and the second concentration are sufficiently equal so that the custom color ink is suitable for printing; for example the first concentration and the second concentration may be substantially equal. As above, "substantially equal" denotes that the concentration of the custom color ink in the custom color ink container 42 is within a range of +/−0.05%, +/−0.04%, +/−0.03%, +/−0.02%, or +/−0.01% of the concentration of the custom color ink in the further custom color ink container 60. In a further example, the liquid vehicle and pigment particles are substantially homogeneously dispersed, so they are sufficiently evenly distributed in the custom color ink, to provide an even color distribution when printed to a print medium.

Figure 4:
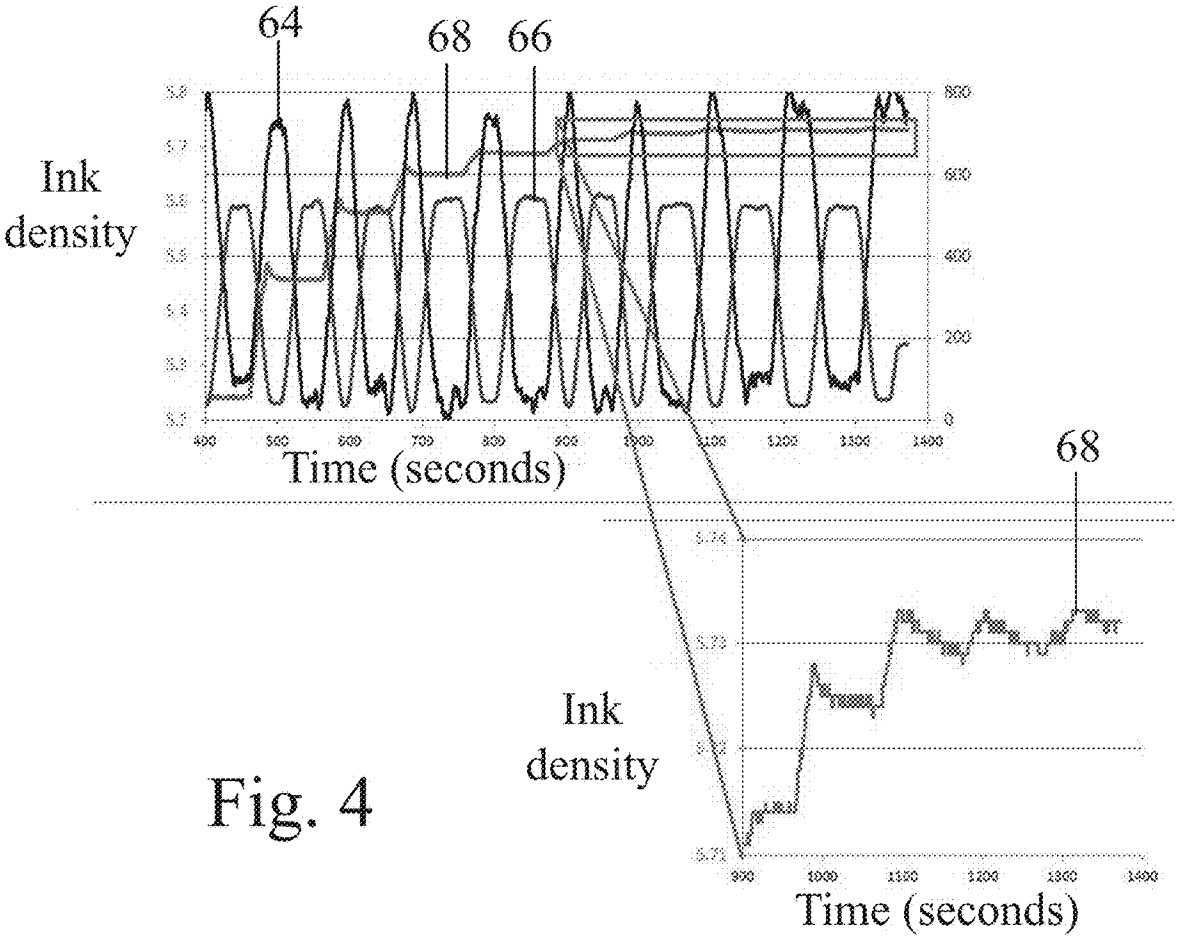
FIG. 4 shows an example plot of a pigment particle weight, a liquid vehicle volume and an ink density in a further ink container as a function of time.

FIG. 4 shows the change in concentration with time as the custom color ink is transferred back and forth between the custom color ink container 42 and the further custom color ink container 60. The volume of the custom color ink 66 in the custom ink color container 42 decreases in accordance with an increase in the volume of custom color ink 64 in the further custom ink color container 60 so that the total volume of custom color ink remains constant. The custom color ink may then be transferred from the further custom color ink container 60 to the custom color ink container 48 such that the volume of custom color ink 66 in the custom ink color container 42 increases in accordance with a decrease in the volume of custom color ink 64 in the further custom ink color container 60. The transfer of the custom color ink back and forth between the custom color ink container 48 and the further custom color ink container 60 may be performed repeatedly to mix the custom color ink with the liquid vehicle such that the concentration of the ink, in other words the ink density 68, in the further custom color ink container 60 throughout the ink volume increases until reaching a plateau once the liquid vehicle and the pigment particles are substantially homogeneously distributed in the liquid vehicle of the ink. Thus, the concentration of the custom color ink in the custom color ink container 42 is sufficiently equal to the concentration of the custom color ink in the further custom color ink container 60 that the custom color ink is suitable for printing; for example, the concentration of the custom color ink in the custom color ink container 42 may be substantially equal to the concentration of the custom color ink in the further custom color ink container 60.

As described above for a base color ink, the ink supply apparatus may comprise a sensor for measuring the concentration of the custom color ink where, for example, the sensor is an optical density sensor. In a further example, the sensor may use the dependence of the mechanical properties of the custom color ink, such as the viscosity, on its concentration to measure the custom color ink concentration. In alternative examples, the interaction of high frequency electromagnetic radiation, such as gamma rays, with the custom color ink, or a measurement of the ratio between the custom color ink mass and the custom color ink volume, may be used to calculate the concentration of the custom color ink.

The method may include using apparatus as described above with reference to FIGS. 1, 2 and 3.

In examples, to ensure a correct custom color of the custom color ink, the custom color ink comprises at least one of the base color inks, the method including providing a weight of each of the at least one base color inks for the custom color ink, the weight of each base color ink being selected in accordance with the color and volume of the custom color ink to be obtained. For example, the selected weight of a base color ink may be the weight required to produce a custom color ink of a desired color when mixed with a weight of each of the other base color inks for forming the custom color ink. The weight of the base color inks may be measured using a weighing device such as a load cell for monitoring vibrations when operating the printing apparatus may be used. In other examples, a digital balance may be used with a relative accuracy of around +/−3 grams after vibrations of the printing apparatus have been taken into account.

To check if the desired custom color has been obtained, the above example method may further include:

(b) measuring a color characteristic of the custom color ink;

(c) determining if the color characteristic of the custom color ink is different from a desired custom color characteristic of the custom color ink, (d) changing, in accordance with a difference between the measured color characteristic of the custom color ink and the desired color characteristic, a composition of the custom color ink to provide the custom color ink with the desired color characteristic.

The desired color characteristic may be a value entered by an operator, for example from an external measurement of a previously printed color or from a known table of custom colors, for example a Pantone® color. Alternatively, in an example in which the printing apparatus comprises a spectrophotometer, the desired color characteristic may be measured during a previous printing run using the spectrophotometer.

For example, the color characteristic of the custom color ink may be the color of the custom color ink in the Commission Internationale de l'Eclairage (CIE) L*a*b* color space or any other suitable color space, as the skilled person would readily understand. In some examples, the printing apparatus may comprise a spectrophotometer, which may be used to measure the color characteristic of the custom color ink.

In an example, step (c) of the above method may be performed by comparing the measured L*a*b* color of the custom color ink with a desired L*a*b* color.

If there is a difference between the measured and desired color characteristic of the custom color ink, the composition of the custom color ink may be changed such that it more closely matches the desired color characteristic. The process of changing the composition of the custom color ink may be iterative; it may be necessary to measure the color characteristic and change the composition of the custom color ink multiple times in order to achieve the desired custom color ink color characteristic.

For example, the composition of the custom color ink may be changed by mixing the custom color ink with further of any of the base color inks. In an example, the composition of the custom color ink may be changed by adding additional base color inks, which were not previously in the custom color ink. In a further example, the composition may be changed by altering the amount of a certain species of pigment particle which was already in the custom color ink prior to measuring the custom color ink color characteristic. For example, the custom color ink may initially comprise an equal mixture by weight of cyan and magenta pigment particles. After measurement of the color characteristic of the custom color ink and comparison with a desired color characteristic, it may be necessary to change the composition of the custom color ink so there is more magenta than pigment previously; this may be done, in an example, by adding a quantity of magenta pigment particles from a base color ink container containing magenta base color ink. In a further example, the composition of the custom color ink may be changed by changing the amount of liquid vehicle. For example, additional liquid vehicle may be added from a liquid vehicle container to dilute the custom color ink, as described above with reference to FIG. 3.

In the example in which the composition of the custom color ink is changed by adding pigment particles, the quantity of pigment particles added may be determined by using a look-up table data indicative of the ratio of base color ink quantities which create a given color characteristic, for example a given L*a*b* color. The ratio of base color inks in the custom color ink in an example is determined initially by selecting a weight of each the base color inks required for the custom color. By comparing the measured L*a*b* color with the desired L*a*b* color, the required ratio of base color inks in the custom color ink to create the desired L*a*b* color can be determined from the look-up table. The look-up table data may also be adjusted using the measured L*a*b* color; for example, if the measured ratio of base color inks should exactly create the desired L*a*b* color but the measured L*a*b* color differs from the desired L*a*b* color, the required ratio may be adjusted in accordance with this difference. From the ratio of base color inks, the weight of each additional quantity of any of the base color inks required to create the custom color ink can be calculated. The weight of the additional base color inks may be measured using a load cell, for example, to ensure that the correct weights of each base color ink are added to the custom color ink.

The look-up table data may be stored in a memory, which may form part of a processing system, comprising at least one memory and at least one processor, controlling the custom ink mixing. The control system may therefore for example be configured to process measurements of the spectrophotometer, which are indicative of a color characteristic of a custom color ink, to process measurements of the weighing device for weighing the base color inks and for controlling supply of amounts of ink by weight for mixing the color ink.

Once a custom color ink has been prepared and printed via the BID 14 for the custom color ink, the custom ink container 42 and the further custom ink container 60 may need cleaning before preparing a different custom color ink. This cleaning may be performed manually by an operator, or may involve an automated rinsing process using for example a cleaning solution or further of the liquid vehicle.

Examples have been described above of a printing apparatus configured to mix a custom color ink and a method of mixing a custom color ink in a printing apparatus. Custom color inks may therefore be mixed using apparatus which is internal to the printing apparatus and do not require any additional, external equipment, for example, reducing the mess associated with known methods of color mixing. Indeed, a custom color ink may be mixed using only base color inks which can themselves be used to print an image without mixing with another ink. Thus, the custom ink may be mixed simply, without the expense of further inks dedicated for mixing of a custom color ink. Further, the method of mixing a custom color ink may be automated, reducing the effect of operator errors, thus obtaining accurate and consistent custom colors. Although the examples above are described with reference to a liquid electro-photographic ink, it is to be appreciated that in further examples the concepts described herein may be applied to other liquid based inks.

In the example described above, with reference to FIG. 3, each base color ink is transferred from a base color ink container 40 to a dispersion unit 48, where it may be diluted with liquid vehicle from liquid vehicle container 50, before being transferred to a further base color ink container 54. However, in other examples, there may be no dispersion units 48 and/or there may be no further base color ink container 54. In those examples, each base color ink may be transferred from the base color ink container 54 to the custom color ink container 42 via the first conduit 44 and when printing a base color ink, directly from the base color ink container 54 to the BID unit 14 via the ink inlet 24. In such examples, the base color ink in the base color ink container 54 may still be diluted by the addition of liquid vehicle from the liquid vehicle container 50; the liquid vehicle may be evenly mixed with the base color ink, for example using a stirring device within the base color ink container 54. In other examples, the base color ink and the liquid vehicle may be circulated between the base color ink container 54 and the BID unit 14 via the ink inlet 24 and the ink outlet 38, without printing the base color ink, until the base color ink and the liquid vehicle are mixed.

In further examples, there may be no further custom color ink container 60. In these examples, the custom color ink may be transferred directly from the custom color ink container 42 to the BID unit 14 via the ink inlet 24. The custom color ink may be mixed with a liquid vehicle from the liquid vehicle container 50 within the custom color ink container 42 by using a stirring device, for example. In other examples, the custom color ink may be mixed with the liquid vehicle by circulating the custom color ink and the liquid vehicle between the custom color ink container 42 and the BID unit 14 via the ink inlet 24 and the ink outlet 38 without printing the custom color ink to a print medium.

The preceding description has been presented only to illustrate and describe examples of the principles described. This description is not intended to be exhaustive or to limit these principles to any precise form disclosed. Many modifications and variations are possible in light of the above teaching.

The invention claimed is:

1. A printing apparatus comprising:

multiple base color ink containers each to contain a different base color ink;

multiple base color ink dispersion units each connected to a corresponding base color ink container, each dispersion unit to contain a diluted different base color ink, and each dispersion unit connected to a corresponding base color binary ink developer unit;

a custom color ink container connected to each of the multiple base color ink containers or to each of the multiple base color ink dispersion units, to contain a custom color ink, and connected to a custom color ink binary developer unit;

the printing apparatus configured to mix a custom color ink in the custom color ink container using a combination of base color inks and to print any of the custom and base color inks using the custom color ink binary developer unit and the base color binary ink developer units; and the inks are liquid electro photographic inks.

2. The printing apparatus according to claim 1, wherein the custom color ink container is connected to the multiple base color ink dispersion units and the printing apparatus is configured to mix a custom color ink in the custom color ink container using a combination of diluted base color inks from the multiple base color ink dispersion units.

3. The printing apparatus according to claim 2, wherein the multiple base color ink containers comprise a first base color ink container for containing a cyan base color ink, a second base color ink container for containing a magenta base color ink, a third base color ink container for containing a yellow base color ink, and a fourth base color ink container for containing a black base color ink.

4. The printing apparatus according to claim 3, comprising a further custom color ink container and a conduit between the custom color ink container and the further custom color ink container and wherein the printing apparatus is configured to mix the custom color ink by transferring a mixture of any of the base color inks between the custom color ink container and the further custom color ink container via the conduit until the pigment particles of each of the base color inks are substantially homogeneously dispersed with each other.

5. The printing apparatus according to claim 1, where each dispersion unit is connected to a corresponding base color binary ink developer unit through a further base color ink container.

6. A method of making custom color ink for liquid electro photographic printing, comprising:

in a first ink supply apparatus, diluting a first base color liquid electro photographic ink;

in a second ink supply apparatus, diluting a second base color liquid electro photographic ink independent of diluting the first base color ink;

supplying diluted first base color ink from the first ink supply apparatus to a third ink supply apparatus;

supplying diluted second base color ink from the second ink supply apparatus to the third ink supply apparatus; and mixing the diluted first and second base color inks in the third ink supply apparatus to make a custom color electro photographic ink.

7. The method according to claim 6, comprising:

measuring a color characteristic of the custom color ink;

determining if the color characteristic of the custom color ink is different from a desired color characteristic of the custom color ink; and changing, in accordance with a difference between the measured color characteristic of the custom color ink and the desired color characteristic, a composition of the custom color ink to provide the custom color ink with the desired color characteristic.

8. The method according to claim 7, wherein changing the composition of the custom color ink comprises supplying more of the diluted first base color ink and/or more of the diluted second base color ink to the third ink supply apparatus.

9. An ink supply and mixing apparatus for an electro photographic printer, comprising:

a first base color ink supply apparatus including:

a first binary ink developer unit;

a further first base color ink container to supply diluted first base color ink to the first binary ink developer unit;

a first base color ink container to supply undiluted first base color ink to the further first base color ink container; and a first liquid vehicle container to supply a liquid vehicle to the further first base color ink container;

a second base color ink supply apparatus including:

a second binary ink developer unit;

a further second base color ink container to supply diluted second base color ink to the second binary ink developer unit;

a second base color ink container to supply undiluted second base color ink to the further second base color ink container; and a second liquid vehicle container to supply the liquid vehicle to the further second base color ink container; and a third custom color ink supply apparatus including:

a third binary ink developer unit;

a further custom color ink container to supply diluted custom color ink to the third binary ink developer unit; and a custom color ink container to supply custom color ink to the further custom color ink container; the custom color ink container to receive and mix together a first base color ink from the first base color ink supply apparatus and a second base color ink from the second base color ink supply apparatus.

10. The apparatus according to claim 9, where the custom color ink container is to receive undiluted first base color ink from the first base color ink container and undiluted second base color ink from the second base color ink container.

11. The apparatus according to claim 10, where the custom color ink supply apparatus comprises a third liquid vehicle container to supply the liquid vehicle to the further custom color ink container.

12. The apparatus according to claim 9, where:

the first base color ink supply apparatus comprises a first dispersion unit connected to the first liquid vehicle container between the first base color ink container and the further first base color ink container;

the second base color ink supply apparatus comprises a second dispersion unit connected to the second liquid vehicle container between the second base color ink container and the further second base color ink container; and the custom color ink container is to receive diluted first base color ink from the first dispersion unit and diluted second base color ink from the second dispersion unit.

* * * * *